US010293238B1

(12) United States Patent
Shakur

(10) Patent No.: US 10,293,238 B1
(45) Date of Patent: May 21, 2019

(54) EXTENDABLE BASEBALL GLOVE BALL CATCHING DEVICE

(71) Applicant: Sharif Shakur, Orlando, FL (US)

(72) Inventor: Sharif Shakur, Orlando, FL (US)

( * ) Notice: Subject to any disclaimer, the term of this patent is extended or adjusted under 35 U.S.C. 154(b) by 0 days.

(21) Appl. No.: 15/795,239

(22) Filed: Oct. 26, 2017

(51) Int. Cl.

| | |
|---|---|
| ***A63B 71/14*** | (2006.01) |
| ***A63B 71/02*** | (2006.01) |
| ***F21V 21/22*** | (2006.01) |
| ***F21L 4/00*** | (2006.01) |
| ***F21V 23/04*** | (2006.01) |
| *F21Y 115/10* | (2016.01) |

(52) U.S. Cl.
CPC ..... *A63B 71/02* (2013.01); *A63B 71/143* (2013.01); *F21L 4/00* (2013.01); *F21V 21/22* (2013.01); *F21V 23/0414* (2013.01); *A63B 2225/093* (2013.01); *F21Y 2115/10* (2016.08)

(58) Field of Classification Search
CPC ..... A41D 13/085; A63B 71/143; A63B 59/20
See application file for complete search history.

(56) References Cited

U.S. PATENT DOCUMENTS

| | | | | |
|---|---|---|---|---|
| 5,788,608 | A * | 8/1998 | Wilkinson | A63B 21/0724 482/51 |
| 6,500,079 | B1 * | 12/2002 | Tucker, Sr. | A63B 49/08 473/513 |
| 9,730,627 | B2 * | 8/2017 | Andrisani | A61B 5/225 |
| 2005/0233839 | A1 * | 10/2005 | Adams | A63B 60/00 473/513 |

* cited by examiner

*Primary Examiner* — Tajash D Patel
(74) *Attorney, Agent, or Firm* — The Iwashko Law Firm, PLLC; Lev Ivan Gabriel Iwashko

(57) ABSTRACT

An extendable baseball glove ball catching device, including a handle, a telescopic pole connected to the handle at a first end of the telescopic pole, and a baseball glove removably attached to a second end of the telescopic pole.

9 Claims, 2 Drawing Sheets

EXTENDABLE BASEBALL GLOVE BALL CATCHING DEVICE

BACKGROUND OF THE INVENTION

1. Field of the Invention

The present general inventive concept relates generally to a baseball glove, and more specifically, to an extendable baseball glove ball catching device.

2. Description of the Related Art

Baseball fans often attend baseball games with a hope of catching a fly ball or foul ball, which they may later present to baseball players for autographs. However, baseballs that are hit by players and fly into the stands where spectators sit are often out of reach of smaller fans, such as children. More specifically, a small 10 year-old child has a reach disadvantage as compared to other adult fans who try to catch baseballs that are hit into the stands.

Therefore, there is a need for a device that helps smaller baseball fans and children catch baseballs that fly into the stands.

SUMMARY

The present general inventive concept provides an extendable baseball glove ball catching device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an extendable baseball glove ball catching device, including a handle, a telescopic pole connected to the handle at a first end of the telescopic pole, and a baseball glove removably attached to a second end of the telescopic pole.

The handle may include a hand grip, a squeezable portion extending away from a top portion of the hand grip, and a spring disposed between the squeezable portion and the hand grip.

The telescopic pole may include a stationary end portion disposed at the second end of the telescopic pole, a first movable end portion disposed at the second end of the telescopic pole on a first side of the stationary end portion to move inward with respect to the stationary end portion, a second movable end portion disposed at the second end of the telescopic pole on a second side of the stationary end portion to move inward with respect to the stationary end portion, and a connecting mechanism to connect the handle to the first movable end portion and the second movable end portion.

The baseball glove may include a thumb portion to receive the first movable end portion therein, a middle finger portion to receive the stationary portion therein, and a pinky portion to receive the second movable end portion therein.

The connecting mechanism may cause the first movable end portion to move inward with respect to the stationary end portion and the second movable end portion to move inward with respect to the stationary end portion in response to the squeezable portion being squeezed toward the hand grip.

The telescopic pole may include a plurality of light emitting diodes to illuminate in response to a squeezing of the squeezable portion with respect to the handle.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE INVENTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Figure 1:
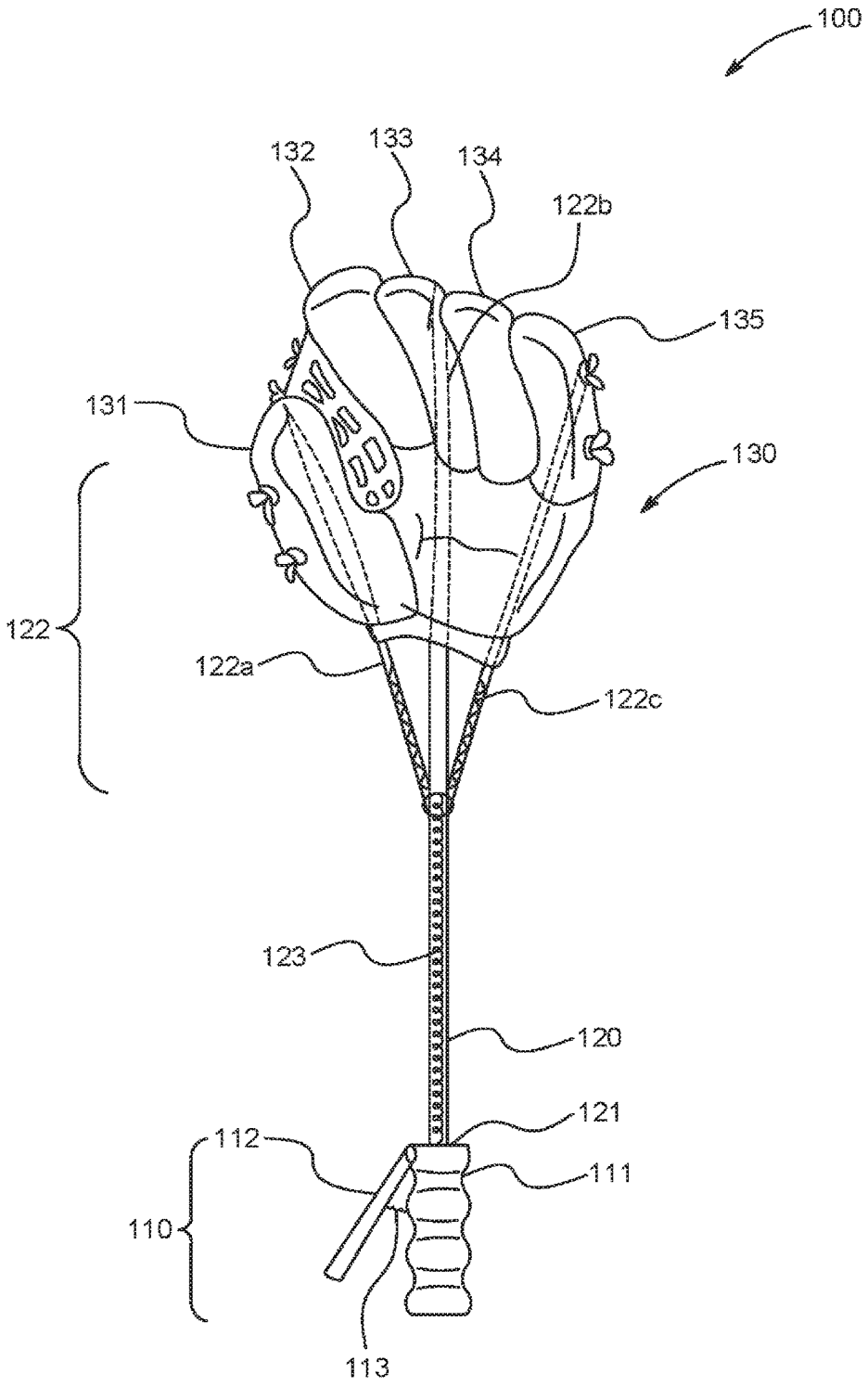
FIG. 1 illustrates an extendable baseball glove ball catching device, according to an exemplary embodiment of the present general inventive concept.

FIG. 1 illustrates an extendable baseball glove ball catching device 100, according to an exemplary embodiment of the present general inventive concept.

Various components of the extendable baseball glove ball catching device 100 may be made from metal, plastic, rubber, cloth, VELCRO, leather, or any other type of material known to one of ordinary skill in the art.

Referring to FIG. 1, the extendable baseball glove ball catching device 100 may include a handle 110, a telescopic pole 120, and a baseball glove 130. The handle 110 may be connected to the telescopic pole 120, which may be removably connected to the baseball glove 130. In other words, the telescopic pole 120 may be connected to the handle 110 at a first end 121 of the telescopic pole 120, and the baseball glove 130 may be removably attached to a second end 122 of the telescopic pole 120.

The handle 110 may include a hand grip 111, a squeezable portion 112, and a spring 113.

A user may hold the extendable baseball glove ball catching device 100 using the hand grip 111.

The squeezable portion 112 may extend away from a top portion of the hand grip 111.

The spring 113 may be disposed between the squeezable portion 112 and the hand grip 111.

When the user squeezes the squeezable portion 112 with respect to the hand grip 111, the spring 113 may cause the user to experience pressure resistance, such that the spring 113 causes the squeezable portion 112 to move away from the hand grip 111 when the squeezable portion 112 is released.

The telescopic pole 120 may be either a single solid pole, or preferably, may be a telescopic pole that is extendable during use, and retractable for storage.

The telescopic pole 120 may include a connecting mechanism 121 therewithin, which connects the handle 110 to the second end 122 of the telescopic pole 120. More specifically, the second end 122 of the telescopic pole may include a first movable end portion 122*a*, a stationary end portion 122*b*, and a second movable end portion 122*c*. The connecting mechanism 123 may be a spring, a pressure system, a series of rubber bands, or any other type of mechanism that causes the first movable end portion 122*a* and the second movable end portion 122*c* to move with respect to the a stationary end portion 122*b*.

The baseball glove 130 may include an opening 131, a thumb portion 132, a forefinger portion 133, a middle finger portion 134, a ring finger portion 135, and a pinky portion 135.

The baseball glove 130 may be inserted onto the end 122 of the telescopic pole 120. More specifically, the first movable end portion 122*a* may be inserted into the thumb portion 132, the stationary portion 122*b* may be inserted into the middle finger portion 134, and the second movable end portion 122*c* may be inserted into the pinky portion 135.

Therefore, when the baseball glove 130 is inserted onto the end 122 of the telescopic pole 120 and the user squeezes the squeezable portion 112 with respect to the hand grip 111, the first movable end portion 122*a* and the second movable end portion 122*c* move inward with respect to the stationary portion 122*b*, thereby causing the thumb portion 132 to move toward the pinky portion 136, thereby "closing" the baseball glove 130. As such, the user may catch a baseball with the glove using the action of the squeezing of the squeezable portion 112 with respect to the hand grip 111.

It is important to note that baseball gloves of various sizes may be used as part of the extendable baseball glove ball catching device 100.

Figure 2:
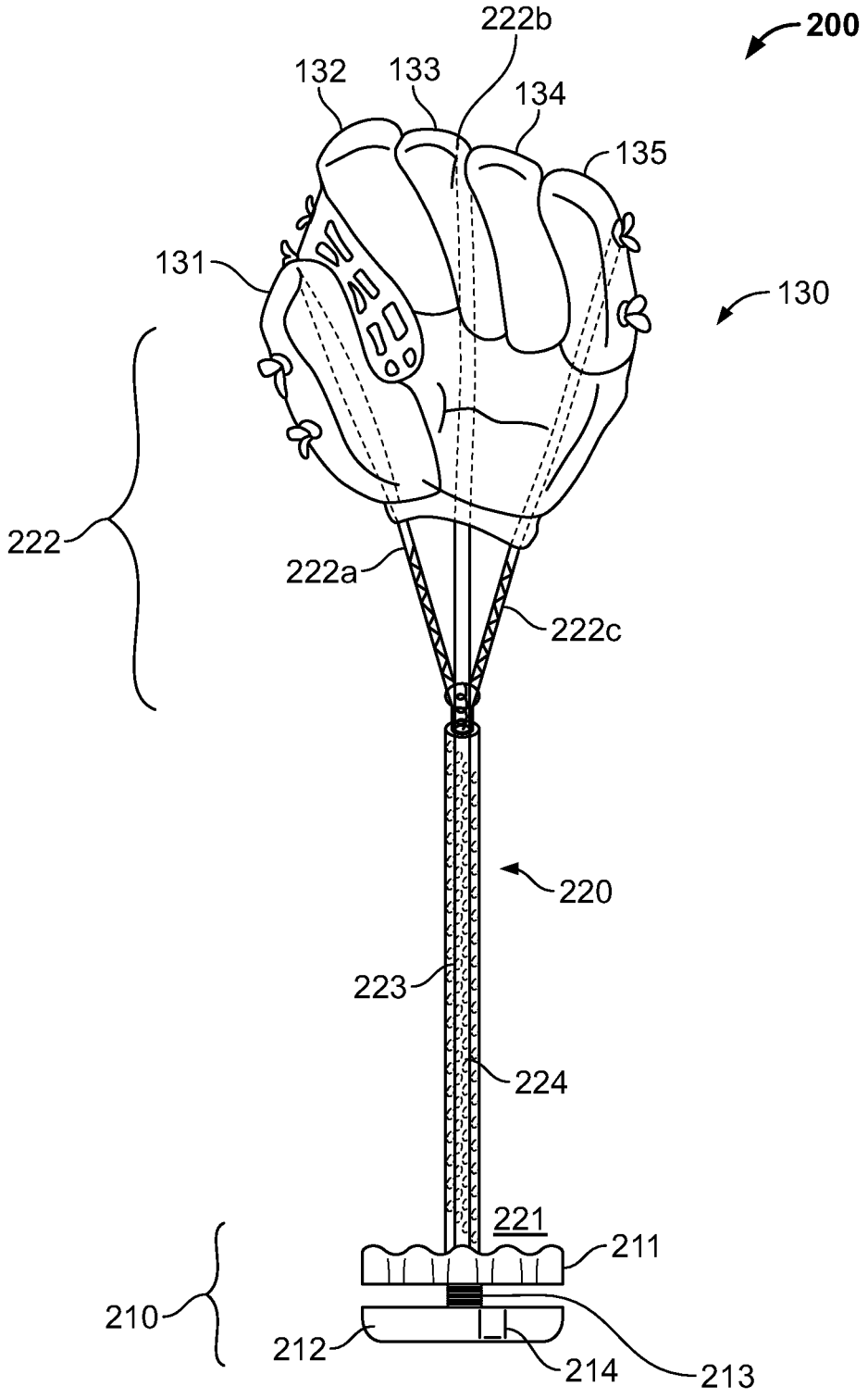
FIG. 2 illustrates an extendable baseball glove ball catching device, according to another exemplary embodiment of the present general inventive concept.

FIG. 2 illustrates an extendable baseball glove ball catching device 200, according to an exemplary embodiment of the present general inventive concept.

Referring to FIG. 2, the extendable baseball glove ball catching device 200 may include a handle 210, a telescopic pole 220, and a baseball glove 130. The handle 210 may be connected to the telescopic pole 220, which may be removably connected to the baseball glove 130. In other words, the telescopic pole 220 may be connected to the handle 210 at a first end 221 of the telescopic pole 220, and the baseball glove 130 may be removably attached to a second end 222 of the telescopic pole 220.

The handle 210 may include a hand grip 211, a squeezable portion 212, and a spring 213.

A user may hold the extendable baseball glove ball catching device 200 using the hand grip 211.

The squeezable portion 212 may extend away from a bottom portion of the hand grip 111.

The spring 213 may be disposed between the squeezable portion 212 and the hand grip 211.

When the user squeezes the squeezable portion 212 with respect to the hand grip 211, the spring 213 may cause the user to experience pressure resistance, such that the spring 213 causes the squeezable portion 212 to move away from the hand grip 211 when the squeezable portion 212 is released.

The telescopic pole 220 may be either a single solid pole, or preferably, may be a telescopic pole that is extendable during use, and retractable for storage.

The telescopic pole 220 may include a connecting mechanism 221 therewithin, which connects the handle 210 to the second end 222 of the telescopic pole 220. More specifically, the second end 222 of the telescopic pole may include a first movable end portion 222*a*, a stationary end portion 222*b*, and a second movable end portion 222*c*. The connecting mechanism 223 may be a spring, a pressure system, a series of rubber bands, or any other type of mechanism that causes the first movable end portion 222*a* and the second movable end portion 222*c* to move with respect to the a stationary end portion 122*b*.

The telescopic pole 220 may be clear (i.e., transparent), and may include a plurality of light emitting diodes (LEDs) 224 having a particular color, or various colors, disposed therewithin. As such, when the user squeezes the squeezable portion 212 with respect to the hand grip 211, the LEDs 224 may illuminate. Every subsequent squeeze of the squeezable portion 212 with respect to the hand grip 211 may cause the LEDs to illuminate in a different color.

The handle 210 may also include a battery 214 that provides power to the LEDs 224.

The baseball glove 130 may include an opening 131, a thumb portion 132, a forefinger portion 133, a middle finger portion 134, a ring finger portion 135, and a pinky portion 135.

The baseball glove 130 may be inserted onto the end 122 of the telescopic pole 120. More specifically, the first movable end portion 122*a* may be inserted into the thumb portion 132, the stationary portion 122*b* may be inserted into the middle finger portion 134, and the second movable end portion 122*c* may be inserted into the pinky portion 135.

Therefore, when the baseball glove 130 is inserted onto the end 122 of the telescopic pole 120 and the user squeezes the squeezable portion 112 with respect to the hand grip 111, the first movable end portion 122*a* and the second movable end portion 122*c* move inward with respect to the stationary portion 122*b*, thereby causing the thumb portion 132 to move toward the pinky portion 136, thereby "closing" the baseball glove 130. As such, the user may catch a baseball with the glove using the action of the squeezing of the squeezable portion 112 with respect to the hand grip 111.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An extendable baseball glove ball catching device, comprising:

a handle;

a telescopic pole connected to the handle at a first end of the telescopic pole; and a baseball glove removably attached to a second end of the telescopic pole, such that the baseball glove is wearable on a hand of the user when the baseball glove is removed from the telescopic pole.

2. The extendable baseball glove ball catching device of claim 1, wherein the handle comprises:

a hand grip;

a squeezable portion extending away from a top portion of the hand grip; and a spring disposed between the squeezable portion and the hand grip.

3. The extendable baseball glove ball catching device of claim 2, wherein the telescopic pole comprises:

a stationary end portion disposed at the second end of the telescopic pole;

a first movable end portion disposed at the second end of the telescopic pole on a first side of the stationary end portion to move inward with respect to the stationary end portion;

a second movable end portion disposed at the second end of the telescopic pole on a second side of the stationary end portion to move inward with respect to the stationary end portion; and a connecting mechanism to connect the handle to the first movable end portion and the second movable end portion.

4. The extendable baseball glove ball catching device of claim 3, wherein the baseball glove comprises:

a thumb portion to receive the first movable end portion therein;

a middle finger portion to receive the stationary portion therein; and a pinky portion to receive the second movable end portion therein.

5. The extendable baseball glove ball catching device of claim 3, wherein the connecting mechanism causes the first movable end portion to move inward with respect to the stationary end portion and the second movable end portion to move inward with respect to the stationary end portion in response to the squeezable portion being squeezed toward the hand grip.

6. The extendable baseball glove ball catching device of claim 2, wherein the telescopic pole comprises a plurality of light emitting diodes to illuminate in response to a squeezing of the squeezable portion with respect to the handle.

7. An extendable baseball glove ball catching device, comprising:

a handle;

a pole connected to the handle at a first end of the pole; and a baseball glove removably attached to a second end of the pole to open and close in response to a manipulation of at least a portion of the handle.

8. An extendable baseball glove ball catching device, comprising:

a handle having a movable and squeezable portion;

a telescopic pole connected to the handle at a first end of the telescopic pole; and a baseball glove removably attached to a second end of the telescopic pole.

9. The extendable baseball glove ball catching device of claim 8, wherein the baseball glove opens and closes in response to the handle being squeezed.

* * * * *